United States Patent [19]

Derderian

[11] 4,439,174

[45] Mar. 27, 1984

[54] BOX-ERECTING MACHINE

[76] Inventor: Edward J. Derderian, 4514 N. Wilson, Fresno, Calif. 93704

[21] Appl. No.: 295,530

[22] Filed: Aug. 24, 1981

[51] Int. Cl.[3] ..... B31B 5/02

[52] U.S. Cl. ..... 493/125; 493/131; 493/180; 493/126

[58] Field of Search ..... 493/125, 126, 121–123, 493/130–132, 180, 183; 53/564

[56] References Cited

U.S. PATENT DOCUMENTS

| | | | |
|---|---|---|---|
| Re. 27,631 | 5/1973 | Berney | 493/131 |
| Re. 30,921 | 5/1982 | McDowell | 493/125 X |
| 3,537,361 | 11/1970 | Derderian et al. | 493/125 X |
| 3,690,224 | 9/1972 | Derderian et al. | 493/124 X |
| 3,739,696 | 6/1973 | Pearson | 493/183 X |
| 4,133,254 | 1/1979 | Odom et al. | 493/125 |
| 4,275,644 | 6/1981 | Moss | 493/183 X |
| 4,285,679 | 8/1981 | Wahle | 493/125 |
| 4,285,682 | 8/1981 | Moss | 493/183 X |

*Primary Examiner*—James F. Coan

*Attorney, Agent, or Firm*—Huebner & Worrel

[57] ABSTRACT

A box-erecting machine characterized by a squaring mechanism for squaring and delivering box blanks to a receiving station, said blanks being characterized by depending leading and trailing minor flaps, a driven reciprocating carriage supported for rectilinear travel including a trailing pusher assembly mounted on the carriage for sequentially engaging each squared box blank and for advancing the blank toward a glue applicator, a major flap folding and compression station, and minor flap folding assembly including pivotal fingers for forwardly infolding the trailing minor flap as it is engaged by the pusher and a rigid tongue mounted in the path of the blank for rearwardly folding the leading minor flap as the blanks are advanced from the box blank receiving station.

4 Claims, 9 Drawing Figures

BOX-ERECTING MACHINE

BACKGROUND OF THE INVENTION

1. Field of the Invention:

The invention generally relates to case or box-erecting machines and more particularly to an improved box-erecting machine including a rear tucker assembly mounted on a blank pusher for forwardly infolding the minor trailing flap of each box blank and supporting the blank as it is advanced across a rearwardly folding leading minor flap folding assembly as the box blank is advanced toward a glue applicator, major flap folding and compression stations.

2. Description of the Prior Art:

The prior art is replete with so-called case or box-erecting machines adapted to square knocked-down, pre-scored blanks into tubular bodies having major and minor panels from which project major and minor closure flaps. The major and minor flaps projected from at least one end of the blank are infolded into overlapped relation and adhesively secured for providing an open end container, alternatively referred to as cartons, boxes, or cases to be filled utilizing manual techniques or mechanically-operated devices.

One of the problems encountered by those engaged in the design and fabrication of box-erecting machines is that of satisfactorily manipulating the leading and trailing flaps, without damaging the blanks, particularly the flaps, while yet accommodating erection and closure of the boxes at at least one end thereof in order to provide a series of erected boxes at a box-filling station.

As can be appreciated by those familiar with box-erecting machines, speed and reliability are of utmost concern, particularly to those engaged in loading or box-filling operations. Therefore, those problems related to flap manipulation continue to plague designers of box-erecting machines. Consequently, there is a continuous on-going search for improved methods and machines for erecting knocked-down, pre-scored blanks into open boxes.

It is, therefore, the general purpose of the instant invention to provide an improved box-erecting machine having improved box-handling mechanisms for infolding leading and trailing minor flaps, while transferring the box blanks through a glue applicator, major flap-folding and compressor station.

OBJECTS AND SUMMARY OF THE INVENTION

It is an object of the instant invention to provide an improved box-erecting machine.

It is another object to provide in combination with a box-erecting machine an improved assembly for infolding leading and trailing flaps of box blanks as box blanks are serially transferred through the machine.

It is another object to provide a box-erecting machine having a capability of safely, reliably and expeditiously erecting box blanks substantially unattended by flap damage.

It is another object to provide in combination with a box-erecting machine an improved box-handling carriage including a pusher assembly for transferring squared box blanks having mounted thereon a bottom trailing flap infolding assembly for infolding bottom trailing flaps while supporting box blanks as they are advanced across a rigidly mounted bottom leading flap folding assembly for infolding the bottom leading flaps of the blanks.

These and other objects and advantages are achieved through the use of a box-erecting machine characterized by a squaring mechanism for delivering squared box blanks to a receiving station, said blanks being characterized by depending leading and trailing minor flaps, a driven reciprocating carriage supported for rectilinear travel having mounted thereon a trailing pusher assembly supporting a minor flap folding assembly including pivotal fingers for forwardly infolding the trailing minor flaps of the blanks as they are engaged by the pusher for advancing the blanks across a leading minor flap folding station characterized by a rigid tongue mounted in the path of the blank and adapted for rearwardly infolding the leading minor flaps as the blanks are advanced from the box blank receiving station toward a glue applicator station, a major flap folding station and a compression station, as will become more readily apparent by reference to the following description and claims in light of the accompanying drawings.

DESCRIPTION OF THE PREFERRED EMBODIMENT

Figure 1:
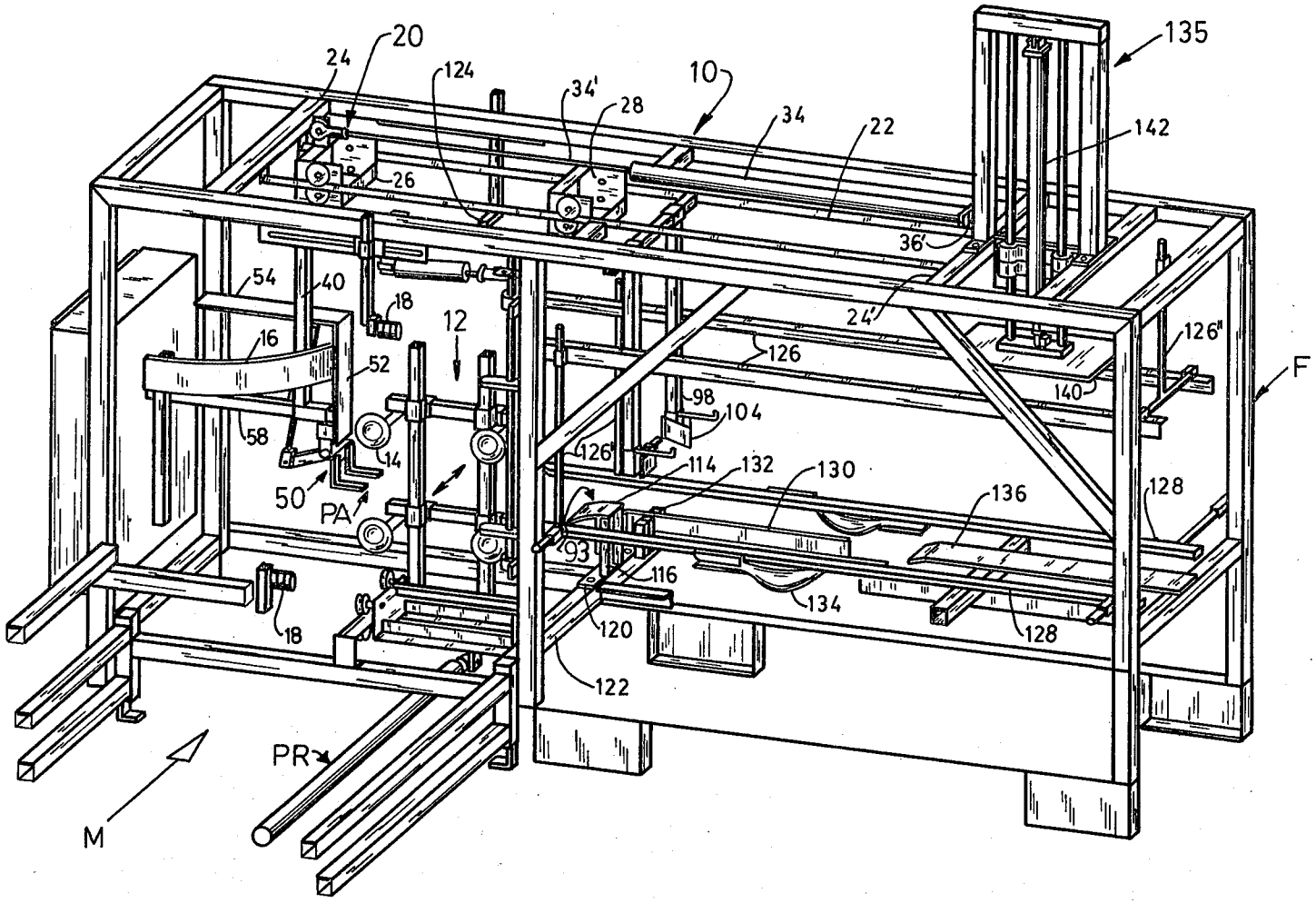
FIG. 1 is a perspective view of a box-erecting machine embodying the principles of the instant invention.

Referring now to the drawings, with more particularity, wherein like reference characters designate like or corresponding parts throughout the several views, there in shown in FIG. 1 a box-erecting machine, generally designated 10, which embodies the principles of the instant invention.

Figure 9:
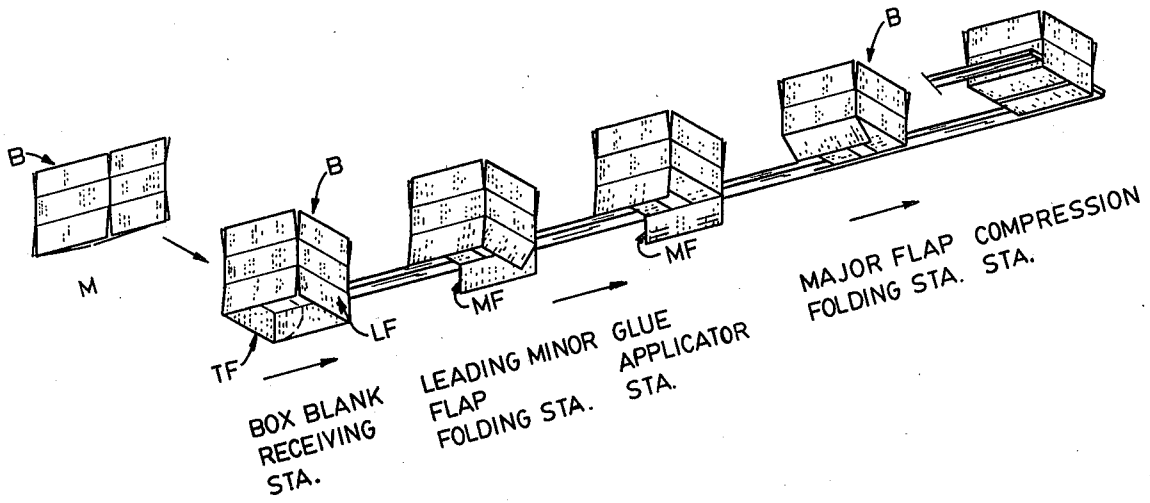
FIG. 9 is a schematic view depicting a box-erecting sequence performed by the machine of the instant invention.

At the outset, attention is invited to FIG. 9. Here, it can be seen that as box blanks B are extracted from a magazine, designated M, they are delivered to a box blank receiving station, designated BOX BLANK RECEIVING STA., with the leading and trailing flaps thereof LF and TF, respectively, depending in substantially vertical planes. As the blanks B are received and advanced from the box blank receiving station, the trailing flap TF is forwardly infolded while the leading minor flap LF is rearwardly infolded toward box-closing dispositions. At a glue applicator station, designated GLUE APPLICATOR STA., adjacent the leading minor flap folding station, glue is applied to the depending minor flaps. At a major flap folding station, designated MAJOR FLAP FOLDING STA., following the glue applicator station, the depending major flaps are infolded into overlapped position with the leading and trailing flaps. The blanks B are then advanced to a compression station, designated COMPRESSION STA., where pressure simultaneously is applied to the overlapped trailing and leading minor and major flaps for purposes of effecting a seal for thus completing the box blank into an open box having a sealed bottom.

As shown in FIG. 1, the box-erecting machine 10 includes a machine frame F fabricated from extrusions including right-angle extrusions, box tubing and the like. The techniques and materials employed in fabricating the frame are well within the skill of the art. Therefore, a detailed description of the techniques and materials employed in the fabrication of the frame F is omitted in the interest of brevity.

The box-erecting machine includes a box blank feeding mechanism having a magazine, aforementioned, of a generally known design. Additionally, a pneumatic picker assembly, designated PA, having a picker ram PR, is included for picking or extracting knocked-down box blanks from the magazine M and squaring the blanks as they are extracted from the magazine and transferred to the box blank receiving station, FIG. 2. A blank feeding mechanism similar in some respects, is shown in Applicant's prior U.S. Pat. application No. 3,537,361.

Figure 2:
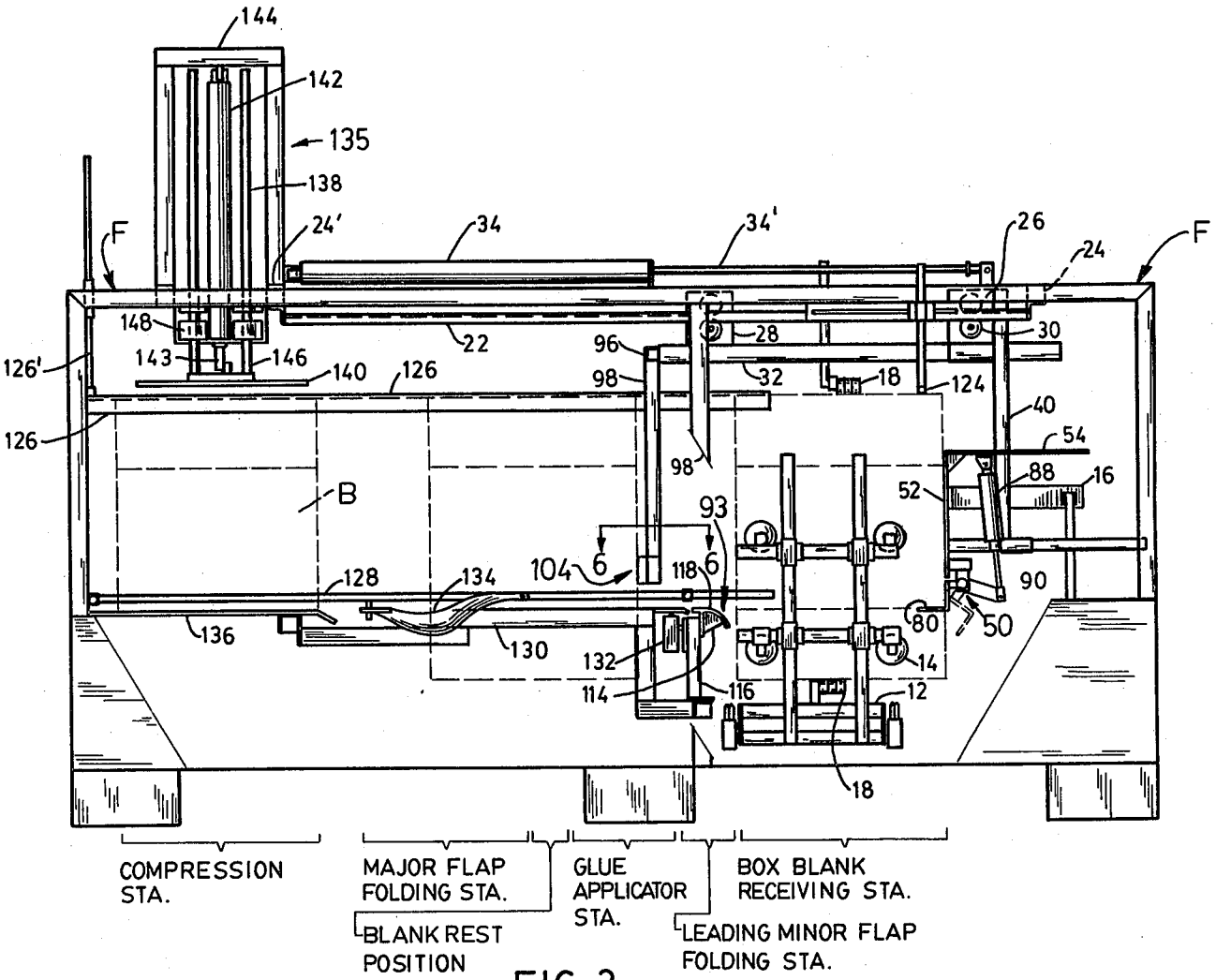
FIG. 2 is a side elevational view of the machine, taken at the side thereof opposite the side shown in FIG. 1.

Referring again to FIG. 1, it should be appreciated that while the details of the picker assembly PA form no part of the claimed invention, the picker assembly includes a reciprocating, pneumatic carriage 12 having suction cups 14 mounted thereon for engaging the leading face of the major panels for the box blanks B, as best shown in FIG. 2. As the carriage 12 is moved in outwardly or in a direction away from the magazine M, an arcuate, horizontally extended squaring arm 16 engages a minor panel for squaring the blank by applying thereto side pressures while the upper and lower major flaps are slightly restrained by tab rollers 18. The purpose of the tab rollers is to maintain alignment of the ends of the flaps and to offer restraint to the rear flap sufficient to support the rearmost panel from inwardly buckling as side pressures are applied by the arm 16 during the squaring of the blank. Consequently, the blanks B are caused to assume a squared tubular configuration as they are extracted from the magazine M and transferred to the box blank receiving station, FIGS. 2 and 9.

The box-erecting machine 10 also includes a box blank transfer carriage, generally designated 20. The purpose of the carriage is to transfer box blanks B from the box blank receiving station through subsequent stations, heretofore mentioned, while simultaneously effecting a forward infolding of the trailing minor flaps TF and a rearward infolding of the leading minor flaps LF, as the box blanks are advanced away from the box blank receiving station, prior to being advanced to the major flap folding station.

Figure 5:
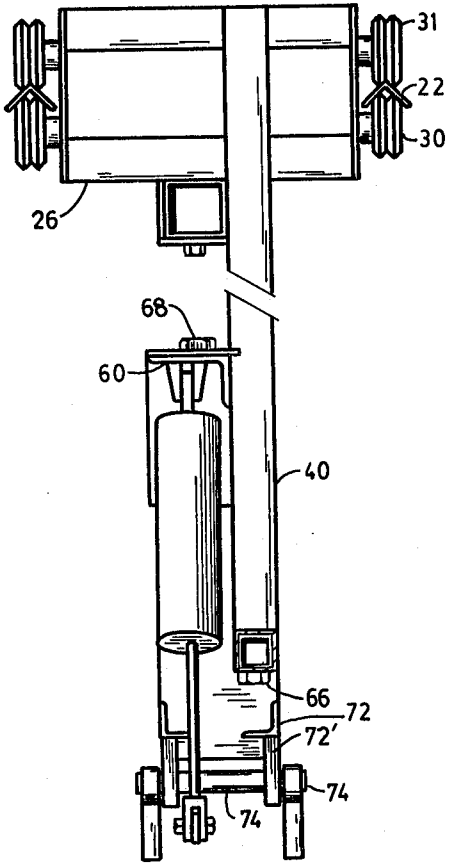
FIG. 5 is an end elevational view, taken generally along lines 5—5 of FIG. 3.

The carriage 20 is supported in suspension for rectilinear reciprocation between an initial position, wherein the carriage is at rest, to an extended position from which it is retracted by a pair of longitudinal rails 22 extended horizontally along the upper portion of the frame. The rails 22 are supported at their opposite ends by transverse frame members 24 and 24'. One frame member, 24 being located near the box blank receiving station and the other transverse frame member 24' being located near the compression station, as best shown in FIGS. 1 and 2. The box blank transfer carriage 20 includes a trailing truck 26 and a leading truck 28 supported by suitably grooved and beveled truck wheels 30 and 31 adapted to mate with the rails 22. As a practical matter, the wheels at each side of the truck are arranged in a vertically oriented pair and rails 22 comprise right-angle extrusions arranged in inverted orientations forming inverted V-shaped channels so that one truck wheel 31 is supported at the upper surface of the related rail 22 while the other wheel 30 of the pair is confined by the V-shaped channel of the rail, at the lower surfaces thereof, FIG. 5.

Figure 3:
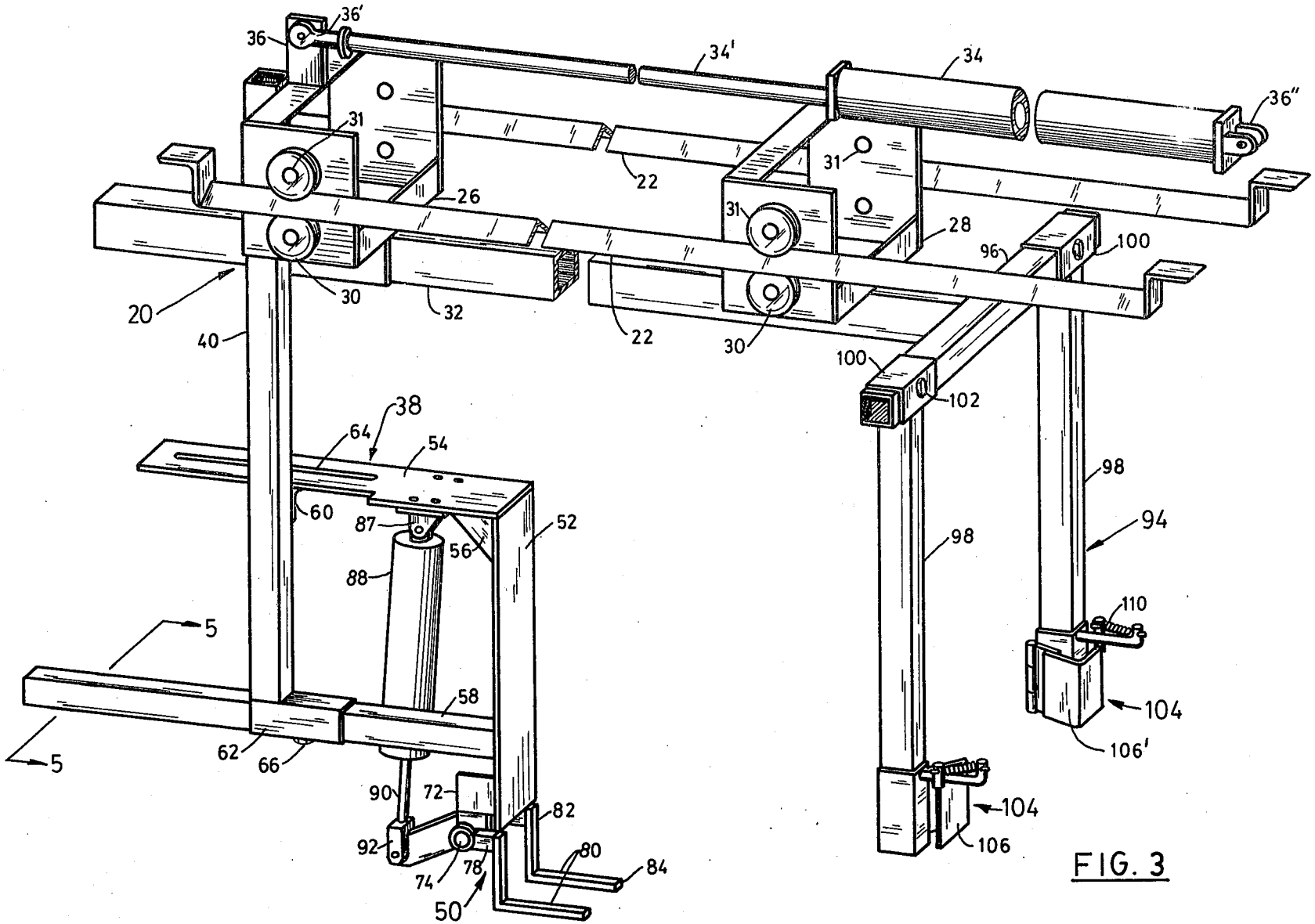
FIG. 3 is a perspective view of a carriage including pusher and trailing flap tucker assemblies employed in transferring and simultaneously infolding the depending minor and major flaps of squared box blanks.

The trucks 26 and 28 are, in turn, interconnected at their lower surfaces by a stringer 32, FIG. 3, which in effect forms a backbone for the carriage 20. The stringer 32 is formed from a length of box tubing and is welded or otherwise rigidly affixed to the trucks 26 and 28 in suspended relation therewith. Thus the trucks 26 and 28 are integrated into a singular unit so that the trucks 26 and 28 are caused to advance and retract along the rails 22, as rectilinear motion is imparted to the carriage 20.

Rectilinear motion of the carriage is achieved through the use of a double-acting air cylinder 34 having a linear actuator or output shaft 34' connected to the truck 26 via a suitable bracket 36 mounted on the truck and a coupling 36' affixed to the shaft. The base end of the air cylinder 34 also is connected to the transverse frame member 24' through a suitable clevis, designated 36'', FIG. 1. Hence, reciprocation of the carriage 20 is effected simply by reversing the pressurization of the air cylinder 34 which serves to extend and retract the linear actuator 34'. Thus the carriage 20 is caused to reciprocate in strokes as the trucks 26 and 28 are advanced and retracted along the rails 22 in a supported relationship therewith. The limits of the strokes are determined by the throw of the output shaft of the cylinder 34, forming the linear actuator 34'.

Depending from the truck 26 is a rear pusher assembly, generally designated 38, the purpose of which is to advance the box blanks B from the box blank receiving station. The rear pusher assembly 38 includes a suspension bar 40 attached to the trailing truck 26 through the use of welds, not shown. The bar 40 serves as a hanger for the rear pusher assembly 38, as well as a trailing flap tucker assembly 50 mounted on the rear pusher assembly 38.

The rear pusher assembly 38 includes a vertical plate 52 suspended from a horizontal bracket plate 54. The face of the plate 52 is oriented to engage the rear or trailing minor panel of box blanks B as they are fed to the box blank receiving station by the picker assembly PA. In practice, the bracket plate 54 and the plate 52 are interconnected by a weld, not shown, as well as a gusset 56. A lower horizontal support beam 58 also is welded or otherwise rigidly affixed to the plate 52 near the lower end portion thereof. The upper bracket plate 54 is seated on a right-angle bracket 60, welded or otherwise affixed to the suspension bar 40, FIG. 5, while the support beam 58 is telescopically received by a sleeve 62 affixed to the lowermost end of the suspension bar 40. The upper bracket 54 is provided with an elongated positional adjusting slot 64 in order that the plate pusher 52 may be moved, for purposes of adjustment, toward or away from the suspension bar 40. A set screw 66, or similar device, is provided for securing the support beam 58 in adjustable fixed relation with the sleeve 62 while a suitable screw 68 is extended through slot 64 and threaded into the bracket 60 for establishing a fixed positional relationship between the bracket plate 54 and the suspension bar 40. Consequently, it is to be understood that the pusher plate 52 may be advanced or retracted relative to the suspension bar 40 for thus adjusting its position relative to the suspension bar 40 for accommodating box blanks of differing sizes.

It is also important to note that mounted on the rear pusher assembly 38, in suspended relation therewith, is a trailing flap tucker assembly 50. The trailing flap tucker assembly 50 is supported by a bracket 72 welded to the lowermost end of the pusher plate 52, beneath the support beam 58. The bracket 72 is provided with a pair of depending legs 72', FIG. 5, which serve as a support for a rod 74 which in effect forms a trunion having its opposite ends supported in bores provided in the lowermost ends of the legs forming bearing blocks, not designated. To the rod 74, at each of its opposite ends, there is rigidly attached, by means of a coupling 76, a pair of arms 78. These arms project radially from the rod 74 and serve as a mount for a pair of flap folding fingers, designated 80. Moreover, the arms 78 are so related to the rod 74 that rotation of the rod about its axis angularly displaces the arms 74 from a first position wherein the arms are in an inclined disposition to a second position wherein the arms are horizontally disposed. It is important to appreciate that while a pair of arms 78 and a pair of fingers 80 preferably are employed, other arrangements also may be employed with good results. Therefore, it is not intended that the flap folding fingers not be limited to a pair but that at least one flap folding finger and supporting arm be employed.

Each of the flap folding fingers 80 includes a base segment 82 and a distal segment 84 normally related to the base segment. The base segments 82 of the fingers 80 are normally related to the arm 78 to which they are affixed. Thus the arms 78 and the segments 84 are arranged in mutual parallelism. Consequently, the distal segments 84 of the fingers 80 are displaceable from a first position wherein they are in an inclined disposition, FIG. 4, to an operative position beneath a box blank, wherein the fingers are horizontally disposed simply by rotating the rod 74.

In order to rotate the rod 74, there is provided a lever arm 86 rigidly affixed to the rod and radially projected therefrom. Suspended from the upper bracket plate 54 by a bracket 87 there is a double-acting air cylinder 88 having an output shaft 90 forming a linear actuator. The distal end of the output shaft 90 is connected to the distal end of the arm 86 through a suitable clevis coupling 92. Consequently, by reversely pressurizing the air cylinder 88, the output shaft 90 is reciprocated for thus angularly oscillating the arm 86, whereby angular motion responsively is imparted to the rod 74 for thus angularly displacing the fingers 80 between their first and operative positions.

Figure 4:
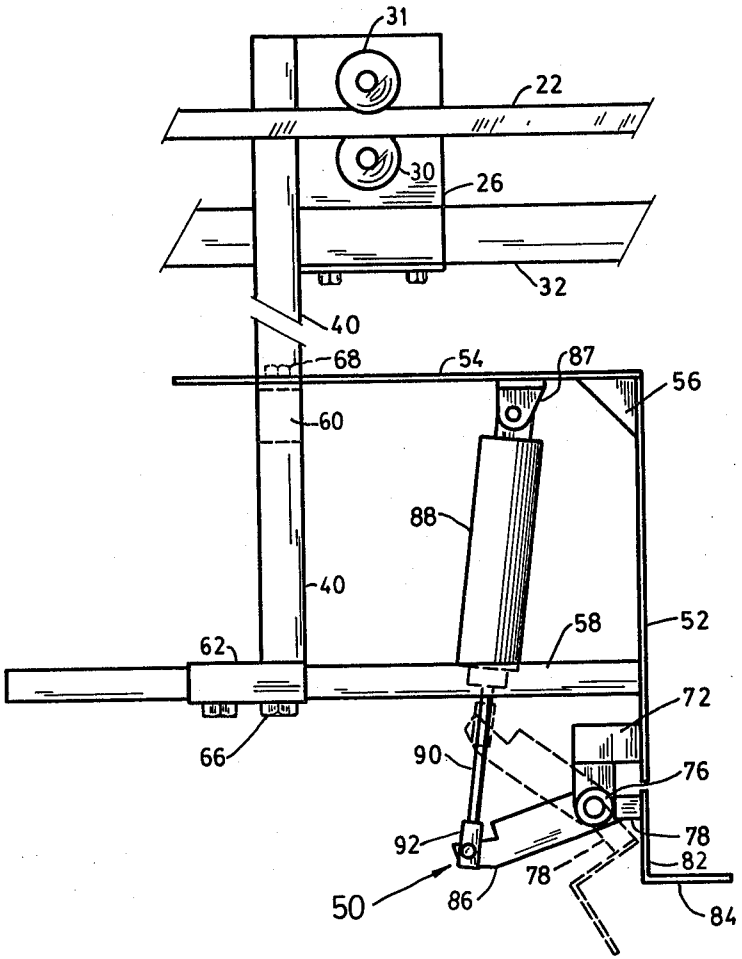
FIG. 4 is a side elevational view of the pusher trailing flap tucker assemblies shown in FIG. 3.

It should now be apparent that once the plate 52 engages a trailing minor panel for a box blank B, located at the box receiving station, an extension of the shaft 90 serves to impart angular displacement to the rod 74 for thus causing the fingers 80 to advance from their first position, engage the trailing minor flap TF for the blank B, and then forwardly infold the trailing minor flap toward a box closing disposition, as the fingers continue to advance toward their operative position, as illustrated in FIG. 4. Thus the trailing minor flap is infolded by the fingers 80.

Once the fingers 80 are advanced to their operative position, the blank B is supported thereby, subsequent to a release thereof by the picker assembly PA. The pusher plate 52 now may be advanced by the box blank transfer carriage 20 for advancing the blank B from the box blank receiving station across a leading minor flap folding assembly, generally designated 93, and through the glue applicator station, to a rest position, designated REST POSITION, FIG. 2, all in a single advancing stroke of the carriage 20. The box blank B will come to rest at its rest position a distance from the box blank receiving station dictated by the limit of the stroke of the carriage.

The box blank transfer carriage 20 further includes a leading pusher assembly 94. This assembly includes a T-bar 96, FIG. 3, welded to what may be considered the leading end of a stringer 32 in a transverse relationship therewith. From each of the projected ends of the T-bar 96, there depends a vertically oriented pusher member 98. In practice, the vertical pusher members 98 are connected to the T-bar 96 by means of an adjustable sleeve 100 telescopically received by the T-bar for accommodating adjustment of the spacing between the members 98. The purpose of the leading pusher assembly 94 is to pick up on an advancing stroke of the carriage 20 a box blank B previously advanced to the rest positions by the rear pusher assembly 38. Further, it should be apparent that the pusher assembly 94, on its return stroke, must pass over a box blank B deposited at the rest position. Consequently, the vertical support members 98 are supported to be adjustably positioned relative to each other in order to accommodate the width of the box blank located at the rest position, whereby the box blank B may pass between the vertical support members 98 as the transfer carriage 20 is returned to its initial position. Thus set screws 102 are provided for securing the sleeves in fixed relation to the T-bar.

In practice, the throw of the linear actuator 34' is sufficient to permit the rear pusher assembly to advance the box blank B through the glue applicator station to the rest position, indicated in FIG. 2.

In order to accommodate both an advancement of a blank B by the leading pusher assembly 94 and a return of the carriage 20 to its initial position, without upsetting the blank B at the rest position, the leading pusher assembly 94 is provided with spring loaded dogs, generally designated 104. These dogs are extensible to engage the trailing major panel of the box blanks B for advancing the box blanks and yet adapted to collapse to permit the dogs to be withdrawn with respect to a box blank B advanced to the rest position as the carriage returns to its initial position.

Figure 7:
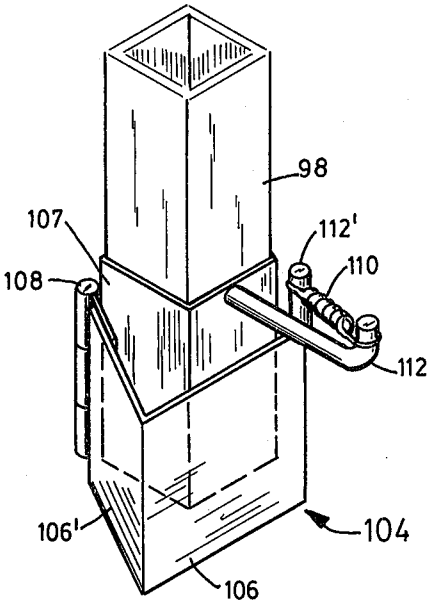
FIG. 7 is a detailed view, on somewhat of an enlarged scale, of a pusher dog, as shown in FIG. 6.
Figure 6:
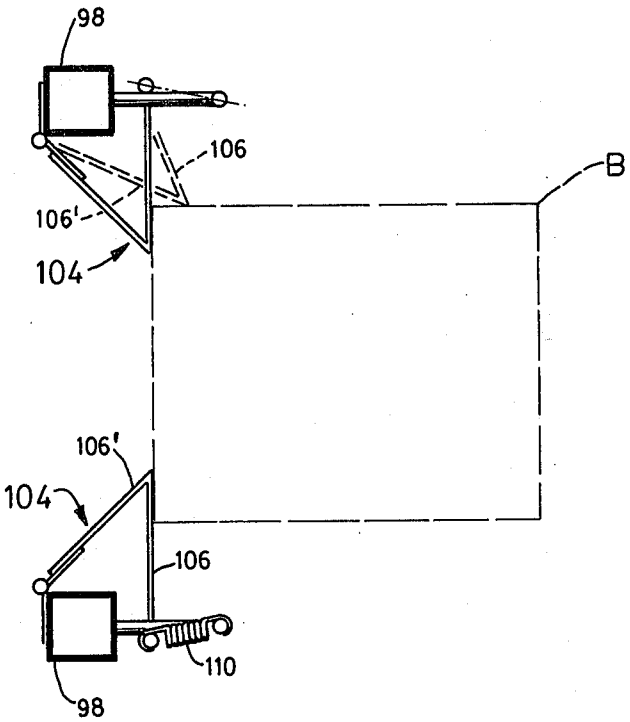
FIG. 6 is a top plan view, taken generally along lines 6—6 of FIG. 2, depicting pusher dogs provided for advancing box blanks through the major flap folding station to a compression station.

As best shown in FIGS. 6 and 7, each of the dogs 104 comprises an angulated member including angularly related surfaces 106 and 106' supported by means of a sleeve 107 affixed to member 98 and an interconnecting hinge member 108. Each dog 104 is biased to its extended or operative position by means of a tension spring 110 connected between anchor post 112, mounted on the dog 104, and an anchor post 112' rigidly attached to the sleeve 107, FIG. 7. Thus the dog 104 is biased toward its operative position by the spring, whereby the surface 106 is positioned substantially transversely with respect to the path of travel for the blanks B in order to engage the trailing minor panel of a blank located at the rest position, as indicated in FIG. 6. Similarly, the surface 106′ when engaged by the box blank B located at the rest position, as the carriage 20 is returned to its initial position, causes the dog 104 to be cammed-over to an inoperative position, as indicated in FIG. 6, for thus permitting the dogs to pass along the opposite major panels of the box blank B until the carriage 20 is returned to its initial position. Of course, once the carriage is at its initial position, surfaces 106 of the dogs 104 are so positioned as to engage the trailing minor panel of the box blank B located at the rest position.

It should now be apparent that as the box blank transfer carriage 20 is advanced for causing the rear pusher assembly to advance a box blank B through the glue applicator station to the rest position, as shown in FIG. 2, the surfaces 106 of the dogs 104 for the leading pusher assembly 94 engage the box blank B immediately preceeding the box blank B engaged by the rear pusher assembly 38 for advancing that box. In practice, the pusher assembly 94 advances each box blank B engaged by the dogs 104 to the compression station, FIG. 2.

As the carriage 20 is returned to its initial position, the box blank B previously advanced by the rear pusher assembly 38 through the glue applicator station to the rest position engages the surfaces 106 of the dogs 104, causing the dogs 104 to collapse against the spring 110 for thus permitting the dogs to pass along the opposite sides of that box blank. The dogs 104 remain thus cammed-over until the carriage 20 is in a position in which the surfaces 106 are spring biased so as to engage the trailing minor panel of the box blank located at the rest position.

The minor flap folding assembly 93, aforementioned, is located at the leading minor flap folding station, immediately adjacent the box blank receiving station, FIG. 2. The assembly 93 includes a leading flap folding tongue 114, the purpose of which is to rearwardly infold the leading minor flap LF. The flap folding tongue 114 is supported by rigid upright frame member 116 and includes an upper arcuate surface 118 so positioned as to engage the midportion of the depending leading minor flaps of blanks B as they are serially advanced by the carriage 20 and to, in effect, upwardly plough the flaps to infolded dispositions, as the blanks pass thereover. In practice, the tongue 114 is welded or otherwise rigidly affixed to the frame member 116 and the frame member 116 in turn, is supported by means of a bracket 120 rigidly affixed to a cross member 112 of the frame F.

In view of the foregoing, it can be seen that the trailing depending flap for each box blank B is forwardly infolded by the trailing flap tucker assembly 50 while the depending leading minor flap is rearwardly infolded by the tongue 114 as the rear pusher assembly 38 advances the box blank B from the receiving station toward the rest position, aforementioned. Thus the flaps TF and LF are folded to a box-end closing disposition.

As a practical matter, a horizontally oriented hold-down foot 124, FIGS. 1 and 2, is affixed to the frame F at the blank receiving station and serves to engage the upper end surfaces of major flaps MF for the box blanks B in order to prevent the box blanks from "riding-up" as they are transferred to the box blank receiving station. Additionally, a pair of horizontally oriented compression bars 126 are provided for confining the upper surfaces of the major flaps of box blanks B as they are transported from the box blank receiving station to the compression station. Similarly, a pair of parallel compression bars 128 extend in parallelism through the machine and engage the major panels of the box blanks for lending lateral support to the blanks as they are advanced by the carriage 20. It is to be understood that the compression bars 126 comprise right-angle extrusions, each having one end adjustably supported by an adjustable stanchion 126′, only one of which is shown, while the other end thereof is supported in suspension by an adjustable hanger 126″.

It is noted that the stanchions 126′ are supported for lateral adjustment in a horizontal plane through the use of suitable sleeves, not designated, whereby the spacing between the compression bars 126 may be varied as desired, and further support the compression bars for adjustment in a vertical plane, also by suitable sleeves, not designated, whereby the vertical position thereof may be adjusted. The hanger 126″, on the other hand, comprises an inverted T-bar adjustably suspended from a cross member of the frame F, by a sleeve, not designated, and serves to support the compression bars 126 for both vertical and lateral adjustment, by suitable means including sleeves, provided on the compression bars and frame for receiving end portions of the T-bar, also not designated, FIG. 1. Thus the compression bars 126 are supported to be adjusted in both vertical and horizontal planes. Of course, the particular manner in which the compression bars 126 are rendered adjustable is deemed a matter of convenience only.

In addition to the compression bars 126, the machine 10 is provided with a pair of side compression bars 128 for applying lateral support to the blanks B as they are advanced. As shown in FIG. 1, one end of the bars 128 are affixed to the stanchion 126′ while the opposite ends thereof are connected to the frame F by horizontal support rods connected to the bars and receiving in suitable sleeves affixed to the frame. As with the compression bars 126, the particular manner in which the bars 128 are rendered adjustable in a horizontal plane is a matter of convenience.

Interposed between and beneath the plane of the compression bars 128 there is a bottom box blank support 130 which extends through the major flap folding station. This support comprises an elongated thin bar, the upper surface of which comprises the narrow dimension. This upper surface serves to receive in supporting relation the bottoms of the box blanks B, along the center line thereof, as they are transferred through the major flap folding station toward the compression station. Thus the major flaps may be infolded by the ploughs 134 without interference, particularly where the edges of the major panels are spaced apart when infolded. The supporting surface of the support 130, of course, is substantially coplanar with the uppermost surface of the flap folding tongue 114.

Disposed immediately adjacent the flap folding tongue 114, at the glue applicator station, there is a hot glue applicator 132, of known design. The purpose of the glue applicator is to deposit hot glue on the lower surfaces of the infolded minor flaps preparatory to the major flaps MF of the box blanks B being folded into an overlapping relationship therewith. The glue applicator is of any suitable design and the details thereof form no specific part of the claimed invention. Therefore, a detailed description of the glue applicator is omitted in the interest of brevity. It is sufficient to understand that the glue applicator is electrically energized and controlled for purposes of applying glue in a selected pattern to the lower surfaces of the minor flaps.

Downstream of the glue applicator station is the aforementioned major flap folding station, FIG. 2. The major flap folding station is provided with the ploughs 134, aforementioned. These ploughs are of known design, and are adapted to engage and infold the depending major panel flaps MF into overlapping relation with the previously infolded minor flaps as the blanks B are advanced through this station.

Located downstream of the bottom box blank support 130, and the major flap folding station at the compression station is a platen comprising an impact plate 136. This plate receives the blank with the bottom flaps thereof disposed in their infolded, box-closing dispositions and supports the box blanks B beneath a compression assembly, generally designated 135. The compression assembly includes with an impact ram assembly 138. This assembly, in turn, is provided with a compression plate 140 comprising a striker plate configured to be received internally of each of the box blanks B for applying impact pressure to the in-folded bottom flaps thereof for thus completing a box erecting cycle of operation for the machine.

The ram assembly 138 also includes a suitable double-acting air ram 142, having a vertically oriented output shaft comprising a linear actuator 143. The linear actuator 143 is connected to the plate 140 and serves to drive the plate 140 against the innermost surfaces of the infolded flaps of each box blank B as it is presented at the compression station. Subsequently, the plate is withdrawn from the thus completed box through reverse travel of the actuator 143.

In practice, a suitable framework 144 is provided for supporting the ram 142 in its vertical disposition while guide rods 146, extended through suitable bearing blocks 148, are mounted on the framework 144 for imparting desired stability to the plate 140 as it is advanced and retracted by the ram. Thus the plate 140 is adapted to be driven into the box blanks in an impacting mode, against the innermost surfaces of the flaps for thus assuring a completion of the sealing thereof and then rapidly withdrawn therefrom.

Figure 8:
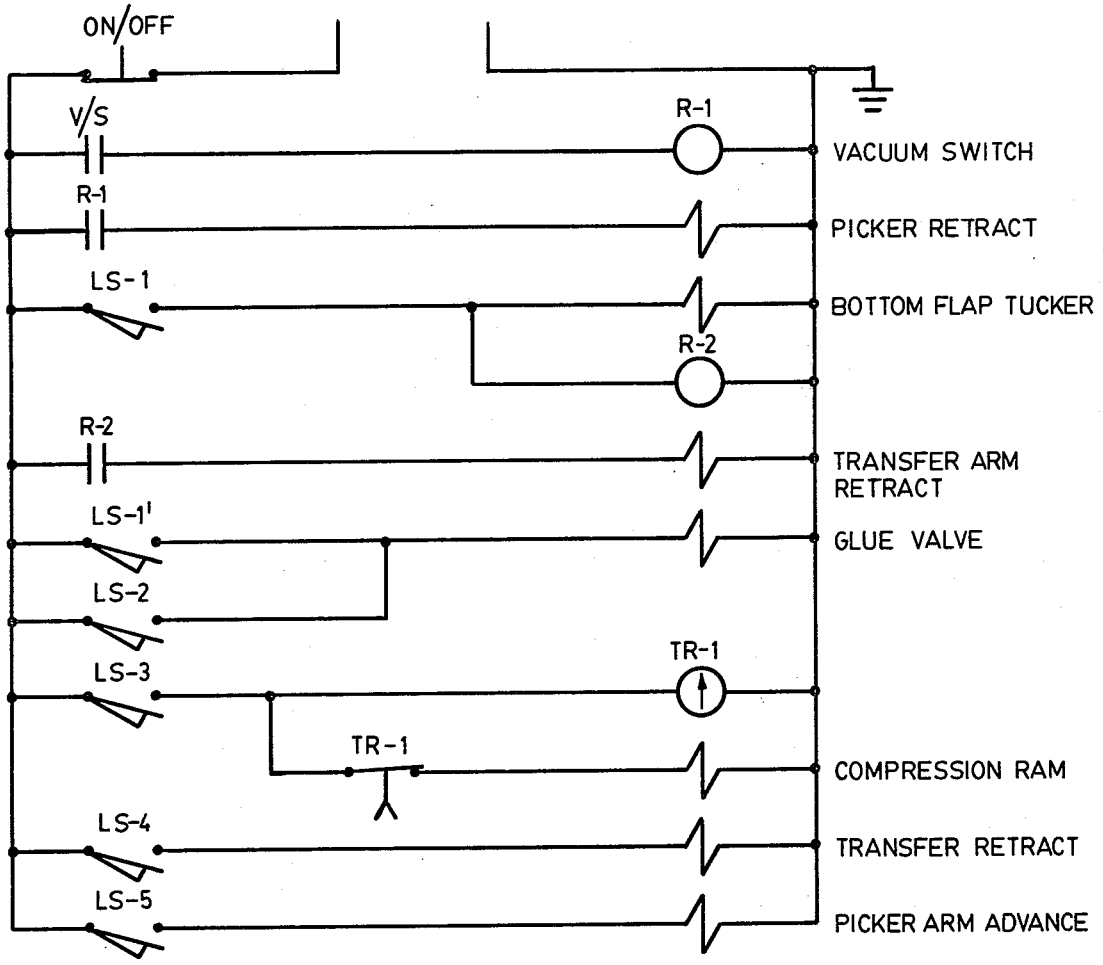
FIG. 8 is a single line diagrammatic view of limit switch circuitry employed in controlling the operation of the box-erecting machine.

With reference to FIG. 8, it can be seen that the control of the operation of the machine may be achieved by a simplified circuit which, in operation, may be varied depending upon desired operations. The circuit illustrated in FIG. 8 is intended to depict a typical circuit which may be provided for controlling the operation of the machine. It is noted that an on-off switch is included. This switch, when closed, serves to energize the circuit. It is to be appreciated that the initial starting point for a cycle of operation for the machine 10 requires the suction cups 14 to be placed in face-to-face engagement with the major panel of a first-in-line, knocked-down blank in the magazine M. Further, when the circuit is switched to "on", a vacuum is applied to the cups 14 causing a vacuum switch V/S to close, energizing a relay R-1. As the relay R-1 is closed, the picker ram PR is energized causing the picker assembly PA to retract. Located in the path of the picker assembly PA is a limit switch LS-1 which when closed initiates an energization of the air cylinder 88 causing the bottom flap tucker assembly 50 to initiate an infolding of the trailing minor flap. In response to a closing of the switch LS-1, a relay coil LR-2 also is energized. This relay serves to initiate a driving operation for the air cylinder 34 for thus causing the carriage 20 to advance. Located in the path of the box blanks B, at suitable locations, are limit switches LS-1 and LS-2 which serve to control the operation of the glue applicator 132. It is to be understood that upon closing of switch LS-1, a first glue pattern is applied to the lower surface of the leading infolded minor flap LF, while the closing of the limit switch LS-2 initiates the application of glue to the lower surface of the infolded trailing minor flap TF. Also located in the path of the box blanks and at a suitable location, not designated, is a limit switch LS-3 which when closed by the presence of a box blank B, initiates a compression cycle for the compression assembly 135 by opening an air valve, not designated, for pressurizing the ram 142. A timer, of suitable design, designated TR-1, is included in the circuit and serves to control the duration of the cycle of operation for the compression assembly 135. That is to say, the timer dictates the duration of the period in which the linear actuator 143 holds the compression plate 140 against the internal surfaces of the infolded flaps for the box blank B. Upon completion of the selected time period, the linear actuator is caused to be withdrawn by the impact ram 142.

Located in the path of the linear actuator 34' for the air cylinder 34 at a suitable location, there is a limit switch LS-4 which, when closed, initiates a reverse operation of the linear actuator 34' for returning the transfer carriage 20 to its initial position. Finally, also located in the path of the linear actuator 34' there is a limit switch LS-5. Simultaneously with the closing of the switch LS-4, the switch LS-5 is closed by the linear actuator 34' for initiating an advance of the picker ram PR for thereby advancing the picker assembly PA to its initial position. Thus the picker assembly is advanced to engage the next box blank B found in the magazine M as the carriage 20 is returned to its initial position by the linear actuator 34' of the ram 34.

OPERATION

It is believed that in view of the foregoing description, the operation of the described invention will readily be understood, however, it will briefly be reviewed at this point.

With the machine 10 assembled in the manner hereinbefore described, it is readied for operation by filling the magazine M with knocked-down box blanks B resting on edge. The picker assembly PA is advanced sufficiently to cause the cups 14 to engage the major panel of the first-in-line box blank B. As the cups 14 engage the box blank with the ON/OFF switch closed, the vacuum switch V/S closes, causing the picker assembly PA to retract for drawing the knocked-down box blank past the squaring arm 16 and between the tab rollers 18, thus permitting the blank B to assume a squared, tubular configuration at the blank receiving station. The minor flaps of the blank are now disposed in depending leading and trailing dispositions. Upon the picker assembly PA reaching the limit of its throw, the limit switch LS-1 is closed for causing the air cylinder 88 to be energized for driving the linear actuator 90 downwardly.

As the linear actuator 90 is driven downwardly, the arm 86 is caused to impart angular displacement to the rod 74 for thus driving the fingers 80 toward a horizontal disposition beneath the box blank B, whereupon the trailing minor flap TF is infolded to a box closing disposition and the blank assumes a supported relationship with the fingers 80. As the limit switch LS-1 is closed, relay coil R-2 is energized for killing the vacuum applied to the cups 14 and, simultaneously, initiating a retraction of the linear actuator 34' by the ram air cylinder 34. As the linear actuator is retracted by the ram 34, the pusher plate 52 engages the trailing major panel of the box blank B at the receiving station, for advancing the box blank between the compression bars 126 and 128, as well as across the flap folding tongue 114. As the box blank B advances across the arcuate surface 118 of the flap folding tongue 114, the orientation thereof is controlled by the compression bars 126 and 128, as well as the pusher plate 52. Continued advancement of the box blank B causes the depending, leading minor flap LF to be ploughed or infolded to a box closing disposition by the tongue 114 acting thereon. The blank B now closes the limit switches LS-2 and LS-3 for initiating application of the glue to the infolded minor flaps. The linear actuator continues to retract, relative to the ram 34, sufficiently for advancing the box blank B to a position wherein the box blank B is positioned to rest upon the bottom box blank support 130 at the rest position with the ploughs 134 engaging the depending major flaps. The limit switches LS-4 and LS-5 are now closed in response to the carriage 20 being advanced to the limit of its travel, causing the carriage 20 to return to its initial position and the picker assembly PA to return to its initial position. It is here noted that during the immediately preceeding stroke of the carriage, a box blank B was caused to be deposited at the rest position. Consequently, the previously deposited blank B must be advanced from the rest position during the subsequent stroke of the carriage 20. This is achieved by the leading pusher assembly 94, which serves to position dogs 104 in engaged relation with the trailing minor panel of the previously deposited blank B and then "pushes" or advances the blank as the carriage 20 is advanced. The leading pusher assembly 94, in practice, advances the engaged blank B to a position beneath the compression assembly 135 to be acted upon by the compression plate 140. Should an erected box be present at the compression station, the advancing blank B serves to "kick" the box out of the way. Thus the blank B is advanced to a position to receive the compression plate in an imparting stroke.

Simultaneously with the closing of the limit switches LS-2 and LS-3, the timer for the compression assembly 135 is initiated, causing the ram 142 to extend the linear actuator 143 for the compression plate 140 downwardly to enter the box blank B located therebeneath and impact the overlapped flaps for assuring a sealed relationship established therebetween. The timer TR-1 serves to control duration of the cycle of the compression assembly 135. As the carriage retracts toward its initial position, the surfaces 106 of the dogs 104 engage the box blank B deposited at the rest position by the carriage 20 on its advancing stroke causing the dogs to collapse against the tension of the springs 110 permitting the carriage to return without damaging the box blank.

A subsequent cycle of operation of the carriage is now initiated as the cups 14 engage the surfaces of the next-in-line knocked-down box blank in the magazine M. As the carriage is advanced, in the manner heretofore described, the surfaces 106 of the dogs 104 engage the rear minor panel of the box blank, previously deposited at the major flap folding station and advance that box blank to the compression station, causing the major flaps to be infolded by the ploughs 134 and the box blank to engage the preceeding box blank and "kick" the previously completed box blank from the compression station while positioning the subsequent or following box blank at the rest position.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A box-erecting machine comprising:

A. a machine frame including means defining a linear path extended through said machine and a box blank receiving station disposed at one end of said path;

B. box blank delivery means for delivering squared box blanks to said receiving station, said blanks being characterized by depending leading and trailing minor flaps and depending major flaps extended between the minor flaps;

C. a glue applicator station, a major flap-folding station, and a compression station arranged in mutually spaced relation and aligned within said path;

D. a reciprocating carriage frame including a rear pusher assembly for advancing box blanks from said receiving station to a rest position and a leading box blank pusher assembly for advancing box blanks from said rest position toward said compression station along said linear path;

E. means supporting said carriage for rectilinear motion including a pair of rails arranged in mutual parallelism and extended across said box blank receiving station, said glue applicator station, said major flap folding station and terminating. adjacent to said compression station, a pair of mutually spaced interconnected trucks mounted on said rails and supported thereby for fore-and-aft rolling motion supporting said carriage frame for reciprocation along said rails, and means including a first air motor for driving said trucks in rolling motion along said rails;

F. a trailing minor flap tucker assembly mounted on said rear pusher assembly for forwardly infolding the trailing minor flap for each of said blanks including a pair of mutually spaced fingers, each finger of said pair being characterized by integral, normally related base and distal segments supported for pivotal displacement from an initial position to an operative position, means for displacing the distal segment from said initial position to said operative position wherein the distal segment is caused to engage the trailing minor flap and infold the flap beneath said box blank, said fingers being disposed in supporting relation with said blank when disposed in said operative position;

G. a second air motor and drive linkage interconnecting said fingers and said second air motor for pivotally displacing said fingers from said initial to said operative positions; and H. means for rearwardly infolding the leading minor flap to a box-closing disposition comprising a leading minor flap tucker assembly including a rigid tongue of an arcuated configuration affixed to said frame and supported within said linear path adjacent to said glue application station over which each box blank is advanced as it is advanced from said receiving station to said rest position.

2. In combination with a box-erecting machine, box blank advancing means for advancing along a linear path a box blank having leading and trailing panels from which depend downward therefrom including:

A. a pair of mutually spaced carriage supporting rails mounted above said path and extended in parallelism therewith and B. a carriage mounted on said pair of rails and supported thereby for rectilinear reciprocation between a box blank receiving position and an extended position remotely related to said box blank receiving station, said carriage being characterized by a. a trailing truck and a leading truck, characterized by each truck having wheels mated in rolling engagement with said rails and adapted to be advanced therealong, b. a stringer interconnecting the trucks in an integrated relationship, c. a rear pusher assembly for advancing a box blank from a blank receiving station to a rest position, said rear pusher assembly being suspended from the trailing truck and characterized by a vertically oriented pusher plate adapted to engage the trailing panel of the box blank, a trailing flap tucker assembly mounted on said pusher plate characterized by at least one finger of an L-shaped configuration and supported for pivotal displacement from a remote position relative to the trailing flap extended downwardly from the trailing panel of said blank to a blank supporting position along a path interrupted by the trailing flap of said blank whereby said trailing flap is engaged and infolded by said finger as the finger is pivotally displaced to said blank supporting position and a double-acting air cylinder having its output shaft connected in driving relation with said finger for imparting pivotal motion to said finger, d. a leading pusher assembly characterized by a cross member affixed to said stringer in leading relation with said leading truck, a pair of mutually spaced, vertically suspended legs adjustably mounted on said cross member, a spring-biased dog affixed to the lower end of each of said legs extensible for engaging the trailing panel of a blank at said rest position and advancing the blank as said carriage is advanced toward said extended position and retractable in response to engagement with a blank at said rest position as said carriage is retracted toward said blank receiving position, and a double-acting air cylinder having an output shaft connected to said carriage for imparting thereto reciprocating motion.

3. A box-erecting machine comprising:

A. a machine frame including means defining a linear path extended through said machine from a box blank receiving station;

B. means for delivering box blanks to the blank receiving station, said blanks having depending leading and trailing minor flaps and depending major flaps, extended between the minor flaps;

C. a glue applicator station;

D. a major flap-folding station;

E. a compression station, said blank receiving station, glue applicator station, flap-folding station and compression station being arranged in spaced relation and along said path;

F. a reciprocating carriage frame including a rear pusher assembly for advancing box blanks from said receiving station to a rest position and a leading box blank pusher assembly for advancing box blanks from said rest position toward said compression station along said path;

G. means supporting said carriage for rectilinear travel through the blank receiving station, the glue applicator station, the flap-folding station and terminating adjacent to the compression station;

H. means for driving said carriage in rectilinear travel through the stations;

I. a trailing minor flap tucker assembly mounted on the rear pusher assembly for forwardly infolding the trailing minor flap for each of the blanks including a pair of mutually spaced fingers, each finger of said pair being characterized by integral, normally related base and distal segments supported for pivotal displacement from an initial position to an operative position, means for displacing the distal segment from said initial position to said operative position wherein the distal segment is caused to engage the trailing minor flap and infold the flap beneath the box blank, said fingers being disposed in supporting relation with said blanks when disposed in said operative position;

J. a second drive means for pivotally displacing the fingers from ititial to operative positions; and K. means for rearwardly infolding the leading minor flap to a box-closing disposition comprising a leading minor flap tucker assembly including a rigid tongue of an arcuate configuration affixed to said frame and supported within the linear path adjacent to said glue application station over which each box blank is advanced in travel from the receiving station to the rest position.

4. In combination with a box-erecting machine, box blank advancing means for advancing a box blank along a linear path, which blank has leading and trailing flaps which depend downwardly therefrom including:

A. a pair of spaced carriage support rails mounted above said path and extended in substantial parallelism therewith and B. a carriage mounted on the rails and supported thereby for rectilinear reciprocation between a box blank receiving position and an extended position remotely related to the box blank receiving station, said carriage being characterized by 1. a trailing truck and a leading truck, each having wheels mated in rolling engagement with the rails and adapted to be advanced therealong, 2. a stringer interconnecting the trucks, 3. a rear pusher assembly for advancing box blanks from a blank receiving station to a rest position, the rear pusher assembly being suspended from the trailing truck and characterized by a vertically-oriented pusher plate adapted to engage the trailing panel of the box blank, 4. a trailing flap tucker assembly mounted on said pusher plate having a finger of an L-shaped configuration and supported for pivotal displacement from a remote position relative to the trailing flap extended downwardly from the trailing flap of the blank to a blank-supporting position along a path interrupted by the trailing flap of said blank whereby said trailing flap is engaged and infolded by the finger as the finger is pivotally displaced to the blank-supporting position, 5. powered means connected in driving relation with the finger for imparting pivotal motion thereto,
6. a leading pusher assembly having a cross member affixed to said stringer in leading relation to the leading truck,
7. a pair of spaced, vertically-suspended legs adjustably mounted on said cross member,
8. a spring-biased dog affixed to the lower end of each of said legs extensible for engaging the trailing panel of a blank at the rest position and advancing the blank as said carriage is advanced toward the extended position and retractable in response to engagement with a blank at the rest position as said carriage is retracted toward the blank-receiving position, and
9. a powered means connected to the carriage for imparting reciprocating motion thereto.

* * * * *

UNITED STATES PATENT AND TRADEMARK OFFICE

CERTIFICATE OF CORRECTION

PATENT NO. : 4,439,174

DATED : March 27, 1984

INVENTOR(S) : Edward J. Derderian

It is certified that error appears in the above-identified patent and that said Letters Patent is hereby corrected as shown below:

Column 3, line 30, delete "application".

Signed and Sealed this

*Third* Day of *July 1984*

[SEAL]

*Attest:*

GERALD J. MOSSINGHOFF

*Attesting Officer*

*Commissioner of Patents and Trademarks*